US012326067B1

(12) United States Patent
Liu et al.

(10) Patent No.: US 12,326,067 B1
(45) Date of Patent: Jun. 10, 2025

(54) INFINITE-STAGE FRACTURING SLIDING SLEEVE

(71) Applicants: Southwest Petroleum University, Chengdu (CN); ChengDu Sinoreal Technology Engineering Co., Ltd, Chengdu (CN)

(72) Inventors: Pingli Liu, Chengdu (CN); Xianzheng Zhao, Chengdu (CN); Fengming Jin, Chengdu (CN); Peng Wang, Chengdu (CN); Jie Tang, Chengdu (CN)

(73) Assignees: Southwest Petroleum University, Chengdu (CN); ChengDu Sinoreal Technology Engineering Co., Ltd, Chengdu (CN)

( * ) Notice: Subject to any disclaimer, the term of this patent is extended or adjusted under 35 U.S.C. 154(b) by 0 days.

(21) Appl. No.: 19/055,084

(22) Filed: Feb. 17, 2025

(30) Foreign Application Priority Data

Aug. 28, 2024 (CN) ..... 202411188271.4

(51) Int. Cl.
*E21B 34/14* (2006.01)
*E21B 43/26* (2006.01)

(52) U.S. Cl.
CPC ..... *E21B 34/142* (2020.05); *E21B 43/26* (2013.01); *E21B 2200/04* (2020.05); *E21B 2200/06* (2020.05)

(58) Field of Classification Search
CPC ..... E21B 23/006; E21B 34/142; E21B 43/26; E21B 2200/06
See application file for complete search history.

(56) References Cited

U.S. PATENT DOCUMENTS 9,004,179 B2 * 4/2015 Chauffe ..... E21B 34/06 166/250.04
9,765,595 B2 * 9/2017 Themig ..... E21B 43/12
(Continued)

FOREIGN PATENT DOCUMENTS

CN 104234661 B 12/2014
CN 106761552 B 5/2017
CN 115853466 3/2023

OTHER PUBLICATIONS

Chen Guangli, Yao Fengsheng, Hu Zhongtai, Li Boren, Tang Liang, "New chase diameter intelligent throw ball slip sleeve and its application" «Chemical Engineering & Equipment» Issue 01, Jan. 15, 2020 (Jan. 15, 2020), pp. 203-204.
(Continued)

*Primary Examiner* — Kenneth L Thompson
(74) *Attorney, Agent, or Firm* — Birchwood IP

(57) ABSTRACT

Disclosed is an infinite-stage fracturing sliding sleeve. The infinite-stage fracturing sliding sleeve includes an outer cylinder, an inner cylinder, a sliding cylinder, an elastic element and a counting mechanism, wherein the inner cylinder closes a fracturing hole on the outer cylinder, and a lower end of the sliding cylinder is provided with an elastic claw. When the number of fracturing balls is less than a preset value, the elastic claw of the sliding cylinder moves in a reduced diameter section and an expanded diameter section in the outer cylinder. After the fracturing sliding sleeve is adopted, the fracturing sliding sleeves of all stages may be driven to open by fracturing balls of the same size, and there is no size difference between the fracturing sliding sleeves of all stages, so that the number of fracturing stages is not limited.

9 Claims, 9 Drawing Sheets

(56) References Cited

U.S. PATENT DOCUMENTS

| | | | | |
|---|---|---|---|---|
| 9,938,798 | B2 * | 4/2018 | Brække | E21B 34/14 |
| 10,119,365 | B2 * | 11/2018 | Sanchez | E21B 34/142 |
| 10,221,648 | B2 * | 3/2019 | Graf | E21B 43/26 |
| 10,337,288 | B2 * | 7/2019 | Gonzalez | E21B 23/006 |
| 10,344,560 | B2 * | 7/2019 | Arabsky | E21B 23/006 |
| 10,392,899 | B2 * | 8/2019 | Gonzalez | E21B 23/006 |
| 11,466,528 | B2 * | 10/2022 | Cho | E21B 43/26 |
| 2013/0161017 | A1 | 6/2013 | King | |
| 2014/0158361 | A1 | 6/2014 | Cheng | |

OTHER PUBLICATIONS

Zhao Chuanwei, etc."Optimization design of counter-type full-bore fracturing sliding-sleeve" «Acta Petrolei Sinica» vol. 39, No. 4, Apr. 15, 2018 (Apr. 15, 2018), pp. 482-490.

* cited by examiner

INFINITE-STAGE FRACTURING SLIDING SLEEVE

CROSS-REFERENCE TO RELATED APPLICATIONS

This application claims priority to Chinese Patent Application No. 202411188271.4, filed on Aug. 28, 2024, which is hereby incorporated by reference in its entirety.

TECHNICAL FIELD

The present application relates to the technical field of downhole operation equipment, in particular to the technical field of fracturing equipment, and specifically to an infinite-stage fracturing sliding sleeve.

BACKGROUND

A fracturing sliding sleeve is a commonly used equipment for staged fracturing. When a conventional fracturing sliding sleeve is used, a fracturing ball is dropped into a wellhead. After the fracturing ball contacts a ball seat, a channel for a fluid to move to a lower part of the ball seat is blocked. Meanwhile, the wellhead is pressurized to push the ball seat to move, thereby opening a channel on a fracturing string. The fracturing fluid fractures the corresponding reservoir segmentation along this channel. When multi-stage fracturing is performed, a size of the fracturing ball is required to increase from bottom to top in sequence, so that fracturing can be performed from bottom to top in sequence. However, this also limits the number of segmentation stages.

SUMMARY

In view of the above problems, an objective of the present application is to provide an infinite-stage fracturing sliding sleeve. When used, upper and lower fracturing sliding sleeves may have the same size, and the fracturing sliding sleeves of each stage may be opened by fracturing balls of the same size. Therefore, theoretically, the number of fracturing stages is not limited.

To achieve the above technical objective, the present application adopts the following technical solutions.

An infinite-stage fracturing sliding sleeve includes:

an outer cylinder, wherein a side wall of the outer cylinder is provided with radially arranged fracturing holes; a reduced diameter section and an expanded diameter section are provided inside the outer cylinder, an inner diameter of the expanded diameter section is greater than an inner diameter of the reduced diameter section, and the expanded diameter section is positioned at one end of the reduced diameter section far away from the fracturing holes;

an inner cylinder whose an outer wall is in a sealing connection with an inner wall of the outer cylinder and configured to close the fracturing hole, wherein the inner cylinder slides along an axial direction of the outer cylinder, and a first connection part is provided at one end of the inner cylinder facing the reduced diameter section;

a sliding cylinder whose an outer wall is in sliding and sealing connection with an inner wall of the reduced diameter section, wherein an upper end of the sliding cylinder is provided with a second connection part is connected to the first connection part, and a lower end of the sliding cylinder is provided with an elastic claw that moves radially; when the elastic claw is positioned in the reduced diameter section, a sealing ball seat matching a fracturing ball and configured to intercept the fracturing ball is formed, and when positioned in the expanded diameter section, the elastic claw expands radially outward, so that a size of a middle through hole is greater than a size of the fracturing ball;

a first elastic element configured to push the sliding cylinder to move towards the inner cylinder; and a counting mechanism configured to count a number of times a fracturing ball passes through the sliding cylinder, wherein when the number of times the fracturing ball passes through the sliding cylinder is less than a preset value, a limit position of the sliding cylinder moving towards the inner cylinder is that the elastic claw is positioned in the reduced diameter section and the second connection part is positioned below the first connection part, and a limit position of the sliding cylinder moving away from the inner cylinder is that the elastic claw is positioned below the reduced diameter section, so that after entering the sliding cylinder, the fracturing ball drives the elastic claw to move from the reduced diameter section to the expanded diameter section, the fracturing ball is released, and after the fracturing ball is separated from the elastic claw, the elastic claw moves to the reduced diameter section; and when the number of times the fracturing ball passes through the sliding cylinder is equal to a preset value, a limit position of the sliding cylinder moving towards the inner cylinder is that the elastic claw is positioned in the reduced diameter section and the second connection part is connected to the first connection part, so that the inner cylinder is driven to move by the sliding cylinder, and a limit position of the sliding cylinder moving away from the inner cylinder is that the fracturing hole is opened and the elastic claw is positioned in the reduced diameter section.

In a specific embodiment of the present application, the counting mechanism includes:

longitudinal grooves positioned on the inner wall of the outer cylinder and arranged along a radial direction of the outer cylinder;

an inclined groove connecting middle parts of two adjacent longitudinal grooves;

a guide rod arranged along a radial direction of the sliding cylinder; and a second elastic element that pushes the guide rod to extend and retract along the radial direction of the sliding cylinder and abut against inner walls of the longitudinal grooves and an inner wall of the inclined groove; wherein with configuration of depths of groove notches of the longitudinal grooves and the inclined grooves, the guide rod moves from one longitudinal groove along the inclined groove to an adjacent longitudinal groove at a certain stage during upward or downward movement of the guide rod along the outer cylinder, and every time the guide rod passes through the inclined groove, counting is performed once; one of the longitudinal grooves includes a counting groove and a target groove, a number of the counting grooves is equal to a preset value, all the counting grooves are connected in sequence via the inclined grooves, the target groove is connected to a last counting groove via the inclined groove, and an upper end of the target groove is positioned above an upper end of the counting groove, so that after the guide rod enters the target groove, the sliding cylinder moves upward to the second connection part to connect to the first connection part.

Further, the longitudinal groove includes a first section and a second section connected in sequence, the second section is positioned below the first section, a connection point between the first section and the second section is connected to an inlet of the inclined groove, and an outlet of the inclined groove is communicated with a middle part of a first section of an adjacent longitudinal groove; at a connection between the first section, the second section and the inlet of the inclined groove, a groove depth of the first section is less than that of the second section, and the second section is smoothly connected to the inlet of the inclined groove; and at a connection between the outlet of the inclined groove and the first section, a groove depth of the inclined groove is less than that of the first section.

Further, the first elastic element or the second elastic element is a spring.

In a specific embodiment of the present application, both the first connection part and the second connection part are a reverse threaded joint.

In a specific embodiment of the present application, the elastic claw is composed of a plurality of L-shaped claws arranged in an annular array, when the elastic claw is positioned at the reduced diameter section, side walls of all L-shaped claws abut against each other to form a closed ring, and when the elastic claw is positioned at the expanded diameter section, all L-shaped claws move radially to separate side walls of the L-shaped claws from each other.

Further, a sealing layer made of an elastic material is arranged in an inner wall of the elastic claw.

In a specific embodiment of the present application, the inner cylinder is fixed to the outer cylinder by shearable pins.

In a specific embodiment of the present application, a limiting boss is arranged on an inner wall of an outer cylinder between reduced diameter sections of the inner cylinder and the outer cylinder, and is configured to limit a limit position of movement of the inner cylinder.

Compared with the prior art, the technical solutions of the present application have the following technical effects.

(1) The fracturing sliding sleeve of the present application may count the number of the passing fracturing balls. When the number of passed fracturing balls reaches a predetermined value, the fracturing balls dropped again plug the ball seat like the fracturing balls in the conventional fracturing sliding sleeve, so that the fluid pressure may be increased through the wellhead to push the fracturing sliding sleeve to open. After such an arrangement, the fracturing sliding sleeves of all stages may be driven to open by fracturing balls of the same size, and there is no size difference between the fracturing sliding sleeves of all stages, so the number of fracturing stages is not limited.

(2) The present application also provides a novel counting mechanism, which can ensure that the guide rod can rotate the sliding cylinder once each time the guide rod completes a downward and upward movement with the clever coordination of the depths of the grooves, thereby completing counting, and the counting is very accurate and reliable.

REFERENCE NUMERALS

Figure 1:
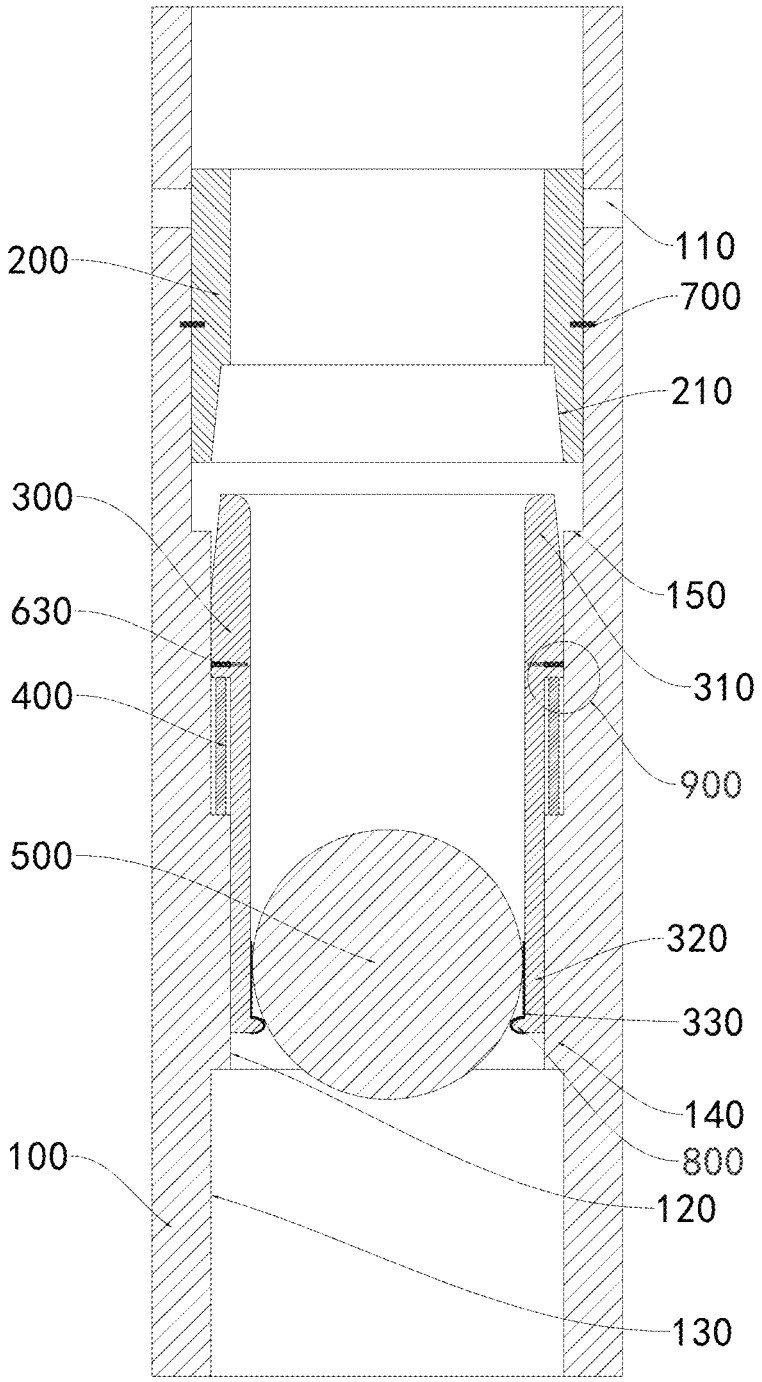
FIG. 1 is a schematic diagram of an infinite-stage fracturing sliding sleeve in an initial state.

100: outer cylinder, 200: inner cylinder, 300: sliding cylinder, 400: first elastic element, 500: fracturing ball, 700: shearable pin, 800: sealing ball seat, 900: counting mechanism,

110: fracturing hole, 120: reduced diameter section, 130: expanded diameter section, 140: annular boss, 150: limiting boss, 210: first connection part, 310: second connection part, 320: elastic claw, 330: sealing layer, 610: longitudinal groove, 620: inclined groove, 630: guide rod, 611: first section, 612: second section, 650: counting groove, 660: target groove, and 640: second elastic element.

DESCRIPTION OF EMBODIMENTS

Embodiments of the present application will be described in detail below, and examples of the embodiments are shown in the accompanying drawings, wherein the same or similar reference numerals indicate the same or similar elements or elements having the same or similar functions throughout. The embodiments described below with reference to the accompanying drawings are illustrative only for the purpose of explaining the present application, and are not to be construed as limiting the present application.

Embodiment

FIGS. 1 to 9 are schematic diagrams of a specific embodiment of an infinite-stage fracturing sliding sleeve according to the present application.

The infinite-stage fracturing sliding sleeve includes an outer cylinder 100, an inner cylinder 200, a sliding cylinder 300, a first elastic element 400, a fracturing ball 500, and a counting mechanism 900. The outer cylinder 100 is provided with through holes arranged along a radial direction of the outer cylinder, which are called fracturing holes 110. An inner wall of the outer cylinder 100 is provided with a reduced diameter section 120 and an expanded diameter section 130, wherein an inner diameter of the expanded diameter section 130 is greater than an inner diameter of the reduced diameter section 120, the expanded diameter section 130 is positioned at one end of the reduced diameter section 120 far away from the fracturing hole 110, as shown in FIG. 1, the inner wall of the outer cylinder 100 is provided with an annular boss 140, an inner wall of the annular boss 140 is the reduced diameter section 120 of the outer cylinder 100, and the expanded diameter section 130 is arranged below the reduced diameter section 120. An outer wall of the inner cylinder 200 is in sealing connection with the inner wall of the outer cylinder 100, the inner cylinder 200 is configured to close the fracturing hole 110, that is, the outer wall of the inner cylinder 200 is opposite to the fracturing hole 110, so that the fluid inside and outside the outer cylinder 100 is prevented from being communicated via the fracturing hole 110, and the inner cylinder 200 can slide along an axial direction of the outer cylinder 100, so that the fracturing hole 110 is opened. A lower end of the inner cylinder 200 is provided with a first connection part 210. The outer wall of the sliding cylinder 300 is in sliding and sealing connection with the inner wall of the reduced diameter section 120, and an upper end of the sliding cylinder 300 is provided with a second connection part 310 that is connected to the first connection part 210. After the first connection part 210 is connected to the second connection part 310, the sliding cylinder 300 can drive the inner cylinder 200 to move downwards in the axial direction, so that the fracturing hole 110 is opened, and fluid inside and outside the outer cylinder 100 is communicated via the fracturing hole 110. The lower end of the sliding cylinder 300 is provided with an elastic claw 320 radially expanding to change the inner diameter, and the elastic claw 320 forms a sealing ball seat 800 matched with the fracturing ball 500 when being positioned at the reduced diameter section 120, so as to intercept the fracturing ball. The fracturing ball 500 enters the sealing ball seat to plug a hollow part of the sliding cylinder 300 and block the fluid from flowing below the sliding cylinder 300. When positioned at the expanded diameter section 130, the elastic claw 320 is expanded radially outward to make the size of the central through hole greater than that of the fracturing ball 500, so that the fracturing ball 500 can normally pass through, i.e., the fracturing ball 500 can be released, and after release, the fluid can flow below the sliding cylinder 300. The first elastic element 400 is configured to push the sliding cylinder 300 to move toward the inner cylinder 200 until the elastic claw 320 is positioned in the reduced diameter section 120. The counting mechanism is configured to count the number of times the fracturing ball 500 passes through the sliding cylinder 300. When the number of times the fracturing ball 500 passes through the sliding cylinder 300 is less than a preset value (the preset number of the fracturing balls allowed to pass through the sliding cylinder), the limit position of the sliding cylinder 300 moving towards the inner cylinder 200 is that the elastic claw 320 is positioned in the reduced diameter section 120 and the second connection part 310 is positioned below the first connection part 210, and the limit position of the sliding cylinder 300 moving away from the inner cylinder 200 is that the elastic claw 320 is positioned below the reduced diameter section 120, that is, the elastic claw is positioned at the diameter expanded diameter section 130. When the number of times the fracturing ball 500 passes through the sliding cylinder 300 is equal to the preset value, the limit position of the sliding cylinder 300 moving towards the inner cylinder 200 is that the elastic claw 320 is positioned in the reduced diameter section 120 and the second connection part 310 is connected to the first connection part 210 into a whole, so that the sliding cylinder 300 can drive the inner cylinder 200 to move away from the inner cylinder 200, and the limit position of the sliding cylinder 300 moving away from the inner cylinder 200 is that the fracture hole 110 is opened and the elastic claw 320 is positioned in the reduced diameter section 120. In this way, the fracturing ball 500 can be ensured to be intercepted, and the fluid is prevented from flowing below the sliding cylinder 300.

Figure 2:
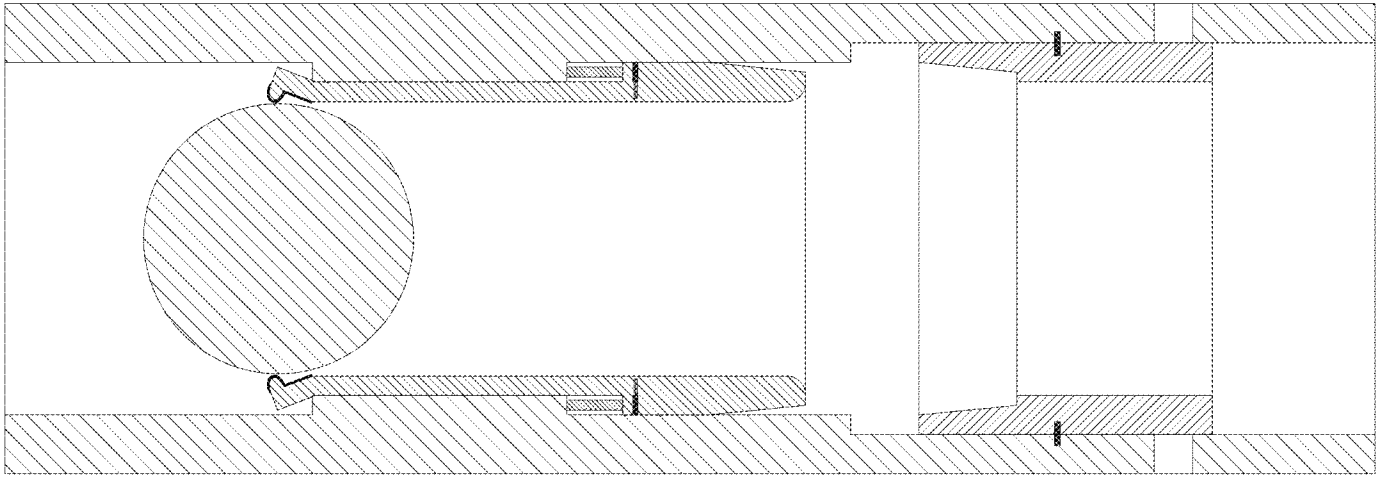
FIG. 2 is a schematic diagram of a state in which a sliding cylinder is driven by fracturing balls to descend to a limit position when a number of the fracturing balls dropped is less than or equal to a number of fracturing balls allowed to pass.
Figure 3:
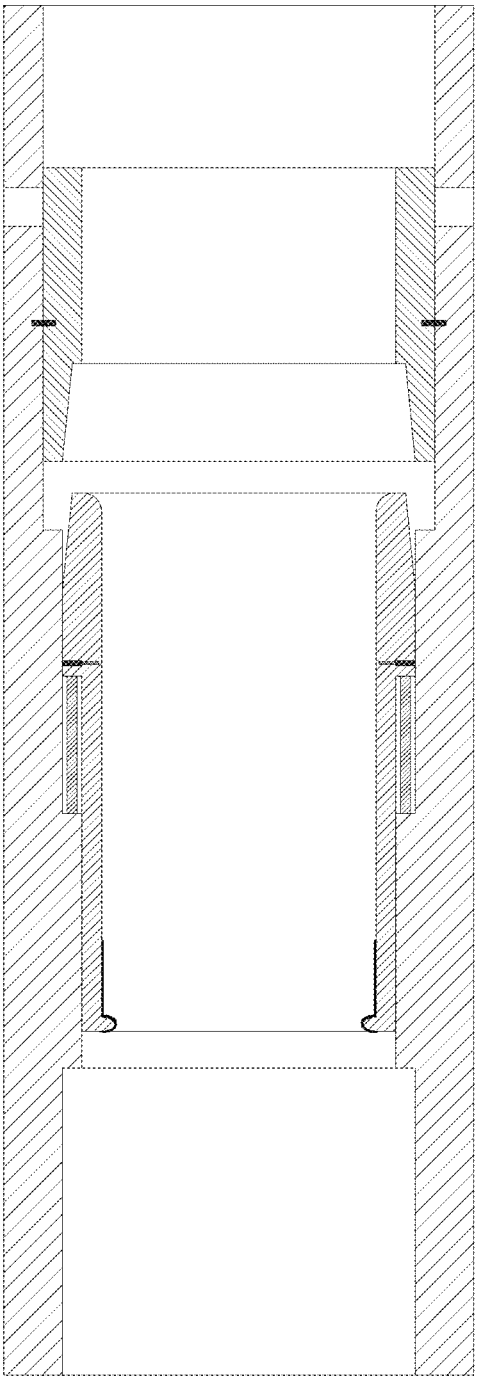
FIG. 3 is a schematic diagram of a state in which a sliding cylinder rises to a limit position after fracturing balls are released when a number of the fracturing balls dropped is less than a number of fracturing balls allowed to pass.
Figure 4:
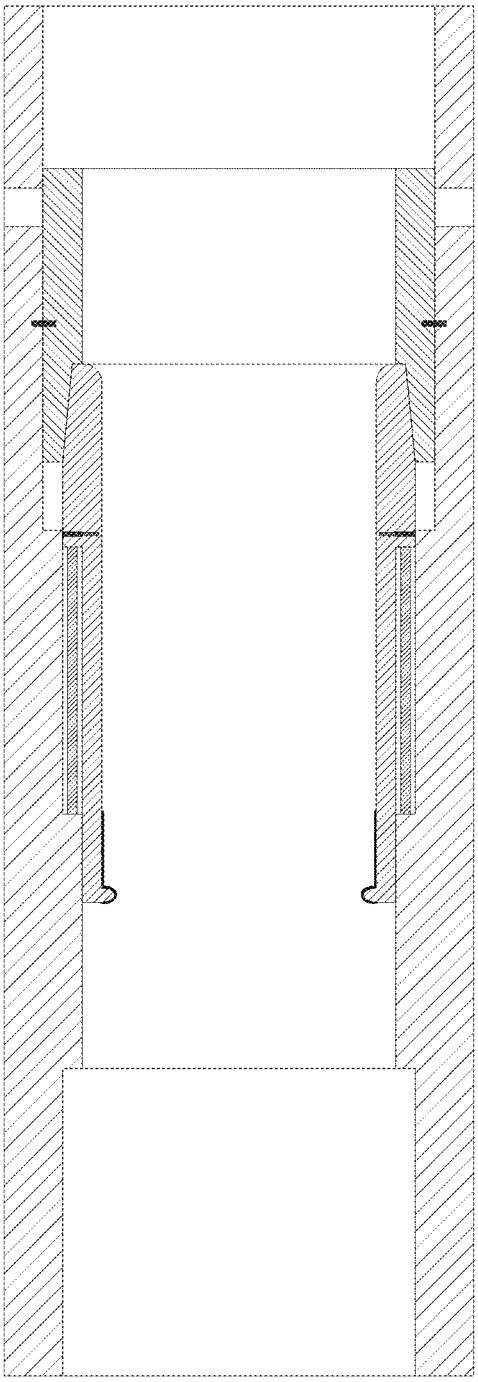
FIG. 4 is a schematic diagram of a state in which a sliding cylinder rises to a limit position after fracturing balls are released when a number of the fracturing balls dropped is equal to a number of fracturing balls allowed to pass.
Figure 5:
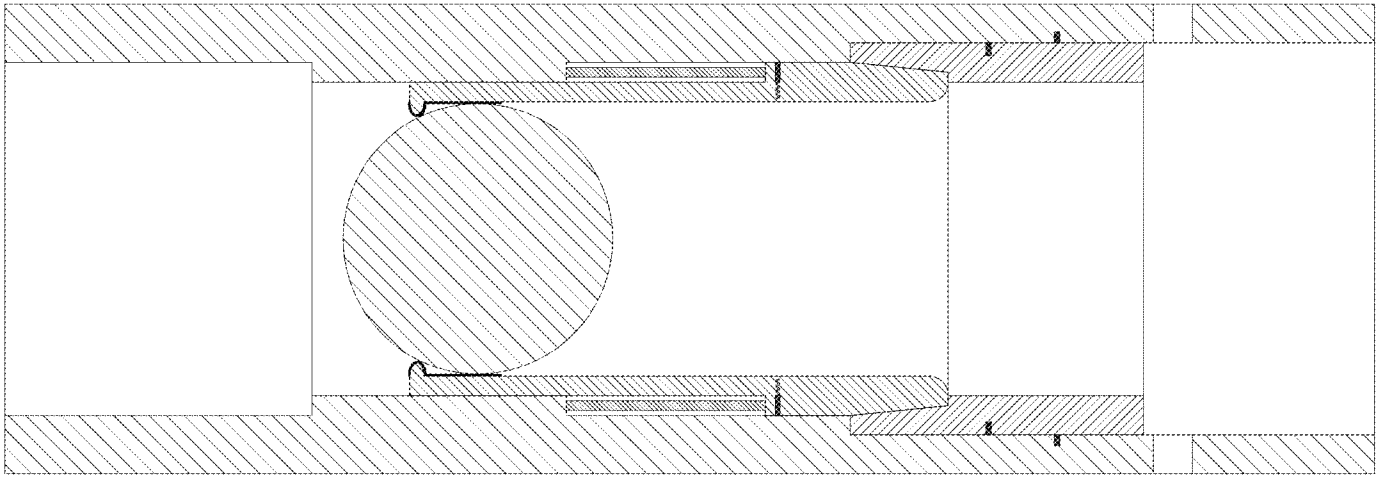
FIG. 5 is a schematic diagram of a state in which a sliding cylinder is driven by fracturing balls to descend to a limit position when a number of the fracturing balls dropped is greater than a number of fracturing balls allowed to pass.

The working process of the present application is shown in FIGS. 1-5. FIG. 1 is a schematic diagram of an infinite-stage fracturing sliding sleeve in an initial state, a fracturing ball 500 enters a sliding cylinder 300, fluid above the fracturing ball 500 is pressurized through a wellhead, the fracturing ball 500 drives the sliding cylinder 300 to move downwards. FIG. 2 is a schematic diagram of a state in which a sliding cylinder is driven by fracturing balls to descend to a limit position when a number of the fracturing balls dropped is less than or equal to a number of fracturing balls allowed to pass. FIG. 3 is a schematic diagram of a state in which a sliding cylinder rises to a limit position after fracturing balls are released when a number of the fracturing balls dropped is less than a number of fracturing balls allowed to pass; FIG. 4 is a schematic diagram of a state in which a sliding cylinder rises to a limit position after fracturing balls are released when a number of the fracturing balls dropped is equal to a number of fracturing balls allowed to pass; and FIG. 5 is a schematic diagram of a state in which a sliding cylinder is driven by fracturing balls to descend to a limit position when a number of the fracturing balls dropped is greater than a number of fracturing balls allowed to pass.

Figure 6:
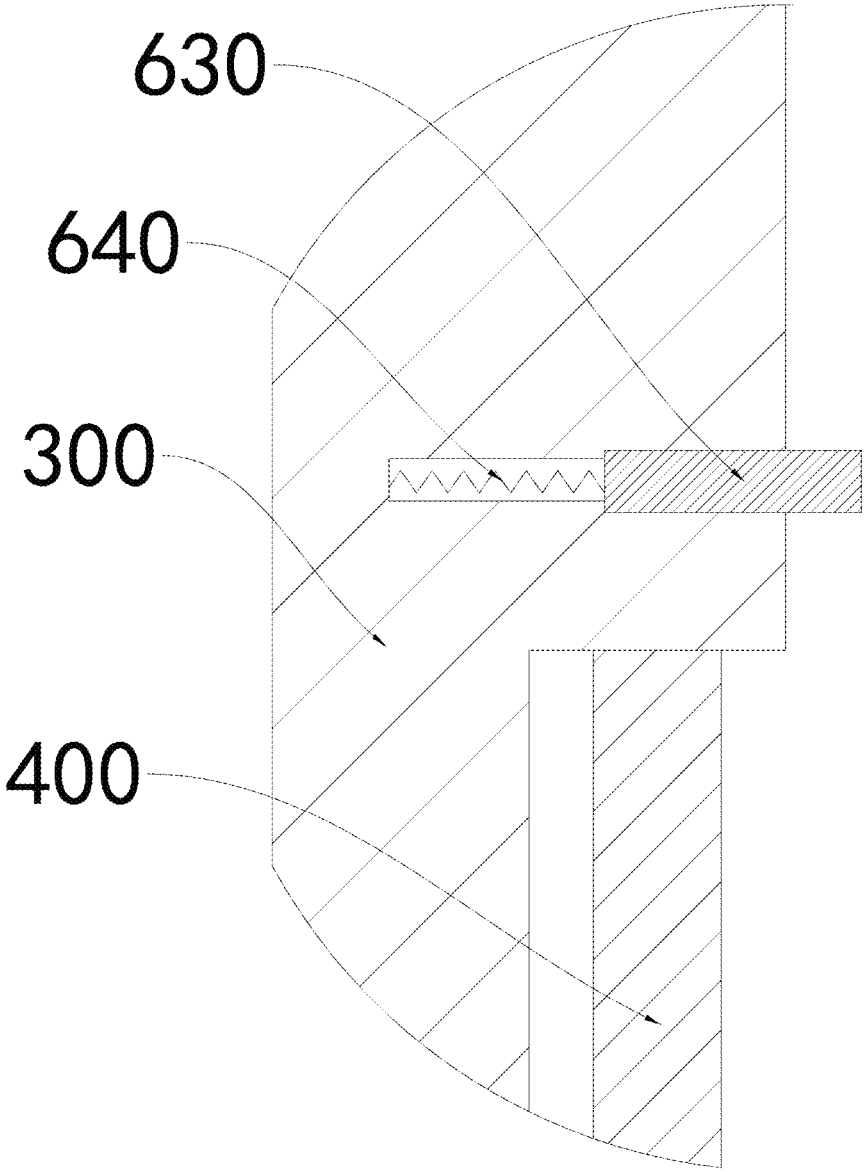
FIG. 6 is a schematic diagram of the arrangement of a guide rod.
Figure 7:
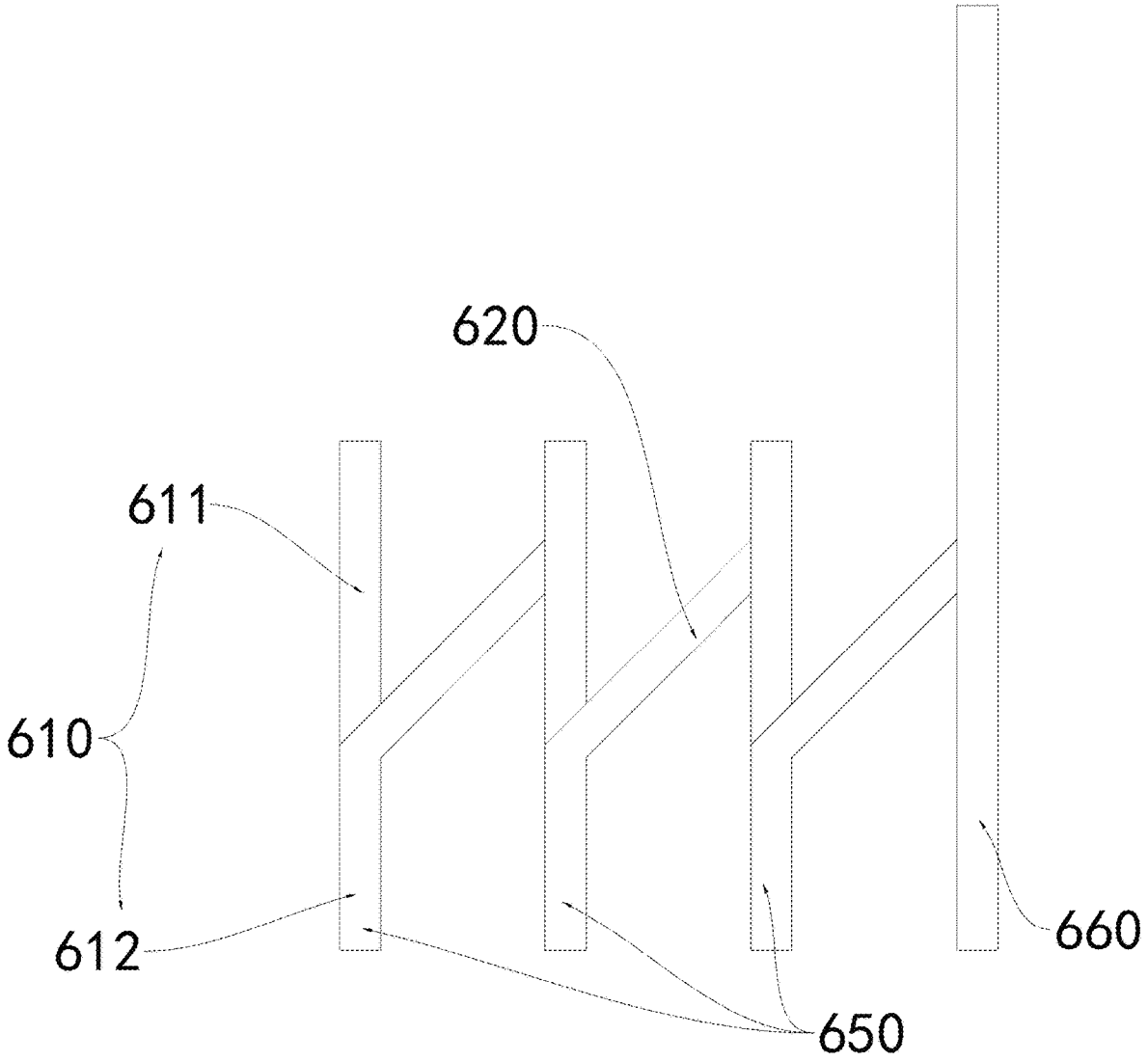
FIG. 7 is a schematic diagram of a longitudinal groove and an inclined groove.

The counting mechanism is a key apparatus of the present application. In some embodiments, counting may be performed by an electromagnetic induction technology. In this embodiment, a mechanical counting mechanism is provided, which can ensure that the sliding cylinder 300 may rotate once every time a downward and upward movement is performed, so as to complete counting. The counting is very accurate. As shown in FIGS. 6 and 7, the mechanical counting mechanism in this embodiment includes longitudinal grooves 610 positioned on the inner wall of the outer cylinder 100 and arranged along a radial direction of the outer cylinder 100, an inclined groove 620 connecting middle parts of two adjacent longitudinal grooves 610, a guide rod 630 arranged along a radial direction of the sliding cylinder 300; and a second elastic element 640, wherein the second elastic element 640 pushes the guide rod 630 to extend and retract along the radial direction of the sliding cylinder 100 and abut against inner walls of the longitudinal grooves 610 and an inner wall of the inclined groove 620. With configuration of depths of groove notches of the longitudinal grooves 610 and the inclined grooves 620, the guide rod 630 moves from one longitudinal groove 610 along the inclined groove 620 to an adjacent longitudinal groove 610 at a certain stage during upward or downward movement of the guide rod 630 along the outer cylinder 100, and every time the guide rod 630 passes through the inclined groove 620, counting is performed once. One of the longitudinal grooves 610 includes a counting groove 650 and a target groove 660, a number of the counting grooves 650 is equal to a preset value, all the counting grooves 650 are connected in sequence via the inclined grooves 620, the target groove 660 is connected to a last counting groove 650 via the inclined groove 620, and an upper end of the target groove 660 is positioned above an upper end of the counting groove 650, so that after the guide rod 630 enters the target groove 660, the sliding cylinder 300 moves upward to the second connection part 310 to connect to the first connection part 210.

The depths of groove notches of the longitudinal grooves 610 and the inclined grooves 620 are matched in various forms. For example, in some embodiments, the longitudinal groove 610 includes a first section 611 and a second section 612 connected in sequence, the second section is positioned below the first section 611, a connection point between the first section 611 and the second section 612 is connected to an inlet of the inclined groove 620, and an outlet of the inclined groove 620 is communicated with a middle part of a first section 611 of an adjacent longitudinal groove 610. At a connection between the first section 611, the second section 612 and the inlet of the inclined groove 620, a groove depth of the first section 611 is less than that of the second section 612, so that the guide rod 630 can smoothly slide from the first section 611 into the second section 612 but cannot slide from the second section 612 into the first section 611. The second section 612 is smoothly connected to the inlet of the inclined groove 620, so that the guide rod 630 can smoothly enter the inclined groove 620 when moving from the second section 612 to the first section 611. Meanwhile, at a connection between the outlet of the inclined groove 620 and the first section 611, the groove depth of the inclined groove 620 is less than that of the first section 611, so as to prevent the guide rod 630 from sliding into the inclined groove 620 when moving from the first section 611 to the second section 612.

Figure 8:
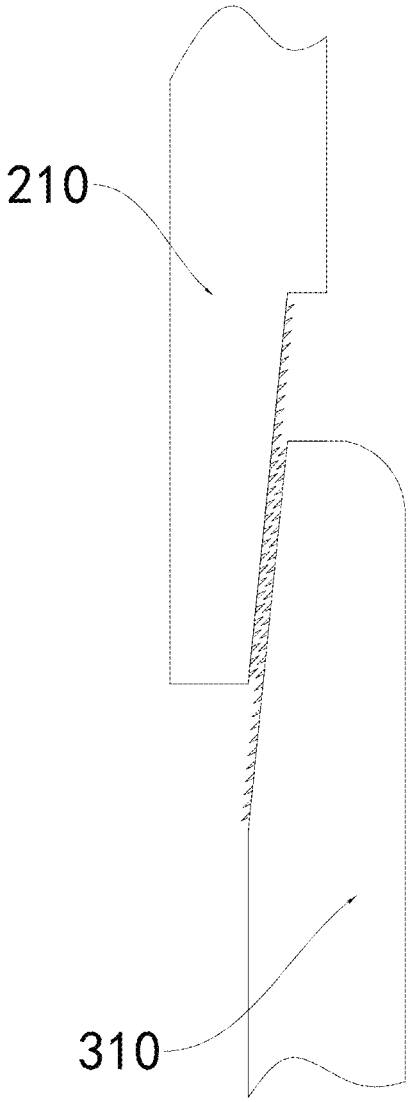
FIG. 8 is a schematic diagram of a connection state between a first connection part and a second connection part.
Figure 9:
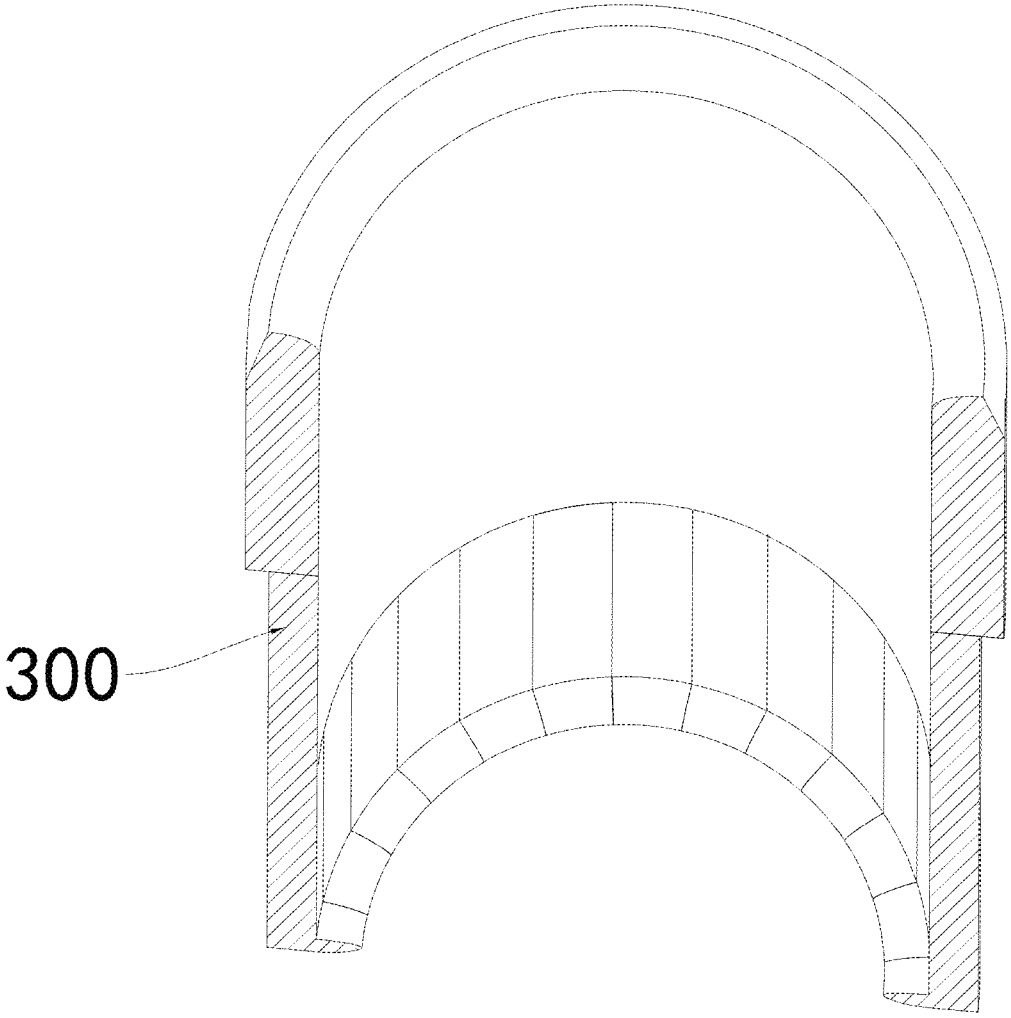
FIG. 9 is a cross-sectional view of a sliding cylinder.

In some embodiments, both the first connection part 210 and the second connection part 310 are a reverse threaded joint. As shown in FIG. 8, after the second connection part 310 is inserted into the first connection part 210, the inner cylinder 200 and the sliding cylinder 300 are connected into a whole. When the sliding cylinder 300 is axially moved downwards, the sliding cylinder 300 drives the inner cylinder 200 to move together, so as to open the fracturing hole 110.

In some embodiments, the elastic claw 320 is composed of a plurality of L-shaped claws arranged in an annular array, and when the elastic claw 320 is positioned at the reduced diameter section 120, side walls of all L-shaped claws abut against each other to form a closed ring, as shown in FIG. 8. When the elastic claw 320 is positioned at the expanded diameter section 130, all L-shaped claws move radially to separate side walls of the L-shaped claws from each other, thereby expanding the size of the internal through hole of the expanded diameter section. In some embodiments, a sealing layer 330 made of an elastic material is arranged in an inner wall of the elastic claw 320, wherein the elastic material may be rubber, so as to increase the sealing performance between the fracturing ball 500 and the elastic claw 320 and reduce the leakage of liquid when the elastic claw 320 is positioned at the reduced diameter section 120.

In some embodiments, to prevent the inner cylinder 200 from accidentally moving, a shearable pin 700 is provided to fix the inner cylinder 200 on the outer cylinder 100. Then when the sliding cylinder 300 pulls the inner cylinder 200 to move, the shearable pin 700 is cut off. In addition, in some embodiments, a limiting boss 150 is arranged on an inner wall of an outer cylinder 100 between reduced diameter sections 120 of the inner cylinder 200 and the outer cylinder 100, and is configured to limit a limit position of movement of the inner cylinder 200, so as to limit the limit position of the movement of the elastic claw 320 away from the inner cylinder 200 after the first connection part 210 is connected with the second connection part 310.

In the present application, both the first elastic element 400 and the second elastic element 640 may be springs.

Although the embodiments of the present application have been shown and described, it may be understood by those of ordinary skill in the art that various changes, modifications, substitutions, and alterations may be made to these embodiments without departing from the principle and purpose of the present application, and the scope of the present application is defined in the claims and equivalents thereof.

What is claimed is:

1. An infinite-stage fracturing sliding sleeve, comprising:

an outer cylinder, wherein a side wall of the outer cylinder is provided with radially arranged fracturing holes; a reduced diameter section and an expanded diameter section are provided inside the outer cylinder, an inner diameter of the expanded diameter section is greater than an inner diameter of the reduced diameter section, and the expanded diameter section is positioned at one end of the reduced diameter section far away from the fracturing holes;

an inner cylinder whose an outer wall is in a sealing connection with an inner wall of the outer cylinder and configured to close the fracturing hole, wherein the inner cylinder slides along an axial direction of the outer cylinder, and a first connection part is provided at one end of the inner cylinder facing the reduced diameter section;

a sliding cylinder whose an outer wall is in sliding and sealing connection with an inner wall of the reduced diameter section, wherein an upper end of the sliding cylinder is provided with a second connection part is connected to the first connection part, and a lower end of the sliding cylinder is provided with an elastic claw that moves radially; when the elastic claw is positioned in the reduced diameter section, a sealing ball seat matching a fracturing ball and configured to intercept the fracturing ball is formed, and when positioned in the expanded diameter section, the elastic claw expands radially outward, so that a size of a middle through hole is greater than a size of the fracturing ball;

a first elastic element configured to push the sliding cylinder to move towards the inner cylinder; and a counting mechanism configured to count a number of times a fracturing ball passes through the sliding cylinder, wherein when the number of times the fracturing ball passes through the sliding cylinder is less than a preset value, a limit position of the sliding cylinder moving towards the inner cylinder is that the elastic claw is positioned in the reduced diameter section and the second connection part is positioned below the first connection part, and a limit position of the sliding cylinder moving away from the inner cylinder is that the elastic claw is positioned below the reduced diameter section, so that after entering the sliding cylinder, the fracturing ball drives the elastic claw to move from the reduced diameter section to the expanded diameter section, the fracturing ball is released, and after the fracturing ball is separated from the elastic claw, the elastic claw moves to the reduced diameter section; and when the number of times the fracturing ball passes through the sliding cylinder is equal to a preset value, a limit position of the sliding cylinder moving towards the inner cylinder is that the elastic claw is positioned in the reduced diameter section and the second connection part is connected to the first connection part, so that the inner cylinder is driven to move by the sliding cylinder, and a limit position of the sliding cylinder moving away from the inner cylinder is that the fracturing hole is opened and the elastic claw is positioned in the reduced diameter section.

2. The infinite-stage fracturing sliding sleeve according to claim 1, wherein the counting mechanism comprises:

longitudinal grooves positioned on the inner wall of the outer cylinder and arranged along a radial direction of the outer cylinder;

an inclined groove connecting middle parts of two adjacent longitudinal grooves;

a guide rod arranged along a radial direction of the sliding cylinder; and a second elastic element that pushes the guide rod to extend and retract along the radial direction of the sliding cylinder and abut against inner walls of the longitudinal grooves and an inner wall of the inclined groove; wherein with configuration of depths of groove notches of the longitudinal grooves and the inclined grooves, the guide rod moves from one longitudinal groove along the inclined groove to an adjacent longitudinal groove at a certain stage during upward or downward movement of the guide rod along the outer cylinder, and every time the guide rod passes through the inclined groove, counting is performed once; one of the longitudinal grooves comprises a counting groove and a target groove, a number of the counting grooves is equal to a preset value, all the counting grooves are connected in sequence via the inclined grooves, the target groove is connected to a last counting groove via the inclined groove, and an upper end of the target groove is positioned above an upper end of the counting groove, so that after the guide rod enters the target groove, the sliding cylinder moves upward to the second connection part to connect to the first connection part.

3. The infinite-stage fracturing sliding sleeve according to claim 2, wherein the longitudinal groove comprises a first section and a second section connected in sequence, the second section is positioned below the first section, a connection point between the first section and the second section is connected to an inlet of the inclined groove, and an outlet of the inclined groove is communicated with a middle part of a first section of an adjacent longitudinal groove; at a connection between the first section, the second section and the inlet of the inclined groove, a groove depth of the first section is less than that of the second section, and the second section is smoothly connected to the inlet of the inclined groove; and at a connection between the outlet of the inclined groove and the first section, a groove depth of the inclined groove is less than that of the first section.

4. The infinite-stage fracturing sliding sleeve according to claim 2, wherein the first elastic element or the second elastic element is a spring.

5. The infinite-stage fracturing sliding sleeve according to claim 1, wherein both the first connection part and the second connection part are a reverse threaded joint.

6. The infinite-stage fracturing sliding sleeve according to claim 1, wherein the elastic claw is composed of a plurality of L-shaped claws arranged in an annular array, when the elastic claw is positioned at the reduced diameter section, side walls of all L-shaped claws abut against each other to form a closed ring, and when the elastic claw is positioned at the expanded diameter section, all L-shaped claws move radially to separate side walls of the L-shaped claws from each other.

7. The infinite-stage fracturing sliding sleeve according to claim 1, wherein a sealing layer made of an elastic material is arranged in an inner wall of the elastic claw.

8. The infinite-stage fracturing sliding sleeve according to claim 1, wherein the inner cylinder is fixed to the outer cylinder by shearable pins.

9. The infinite-stage fracturing sliding sleeve according to claim 1, wherein a limiting boss is arranged on an inner wall of an outer cylinder between reduced diameter sections of the inner cylinder and the outer cylinder, and is configured to limit a limit position of movement of the inner cylinder.

* * * * *